US006691999B2

(12) United States Patent
Gunshera et al.

(10) Patent No.: US 6,691,999 B2
(45) Date of Patent: Feb. 17, 2004

(54) SHEET-BRAKING SYSTEM FOR A DELIVERY OF A SHEET-PROCESSING MACHINE, AND METHOD OF OPERATION

(75) Inventors: Frank Gunshera, Nussloch (DE); Roland Hirth, Römerberg (DE); Sven Kerpe, Eggenstein-Leopoldshafen (DE); Richard Mack, Kennesaw, GA (US); Ralf Weiser, Ladenburg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 181 days.

(21) Appl. No.: 09/737,058

(22) Filed: Dec. 14, 2000

(65) Prior Publication Data

US 2001/0008328 A1 Jul. 19, 2001

(30) Foreign Application Priority Data

Dec. 14, 1999 (DE) ..... 199 60 351

(51) Int. Cl.[7] ..... B65H 29/68
(52) U.S. Cl. ..... 271/183; 271/231
(58) Field of Search ..... 271/183, 231

(56) References Cited

U.S. PATENT DOCUMENTS 4,830,355 A * 5/1989 Jeschke ..... 271/183
5,133,542 A * 7/1992 von Kwiatkowski et al. ..... 271/183
5,265,863 A * 11/1993 Becker ..... 271/183
5,275,394 A * 1/1994 Mank et al. ..... 271/183
5,480,136 A * 1/1996 Meyer ..... 271/176
5,569,016 A * 10/1996 Mokler ..... 271/182

FOREIGN PATENT DOCUMENTS

| | | |
|---|---|---|
| DE | 41 39 888 A1 | 6/1993 |
| DE | 43 43 713 C2 | 6/1995 |
| DE | 43 43 713 A1 | 6/1995 |
| DE | 44 35 988 A1 | 4/1996 |
| DE | 196 49 824 A1 | 10/1997 |
| DE | 196 34 910 A1 | 3/1998 |
| EP | 0 706 966 A1 | 4/1996 |
| WO | WO 95/01931 | 1/1995 |

* cited by examiner

*Primary Examiner*—Christopher P. Ellis
*Assistant Examiner*—Mark A. Deuble
(74) *Attorney, Agent, or Firm*—Laurence A. Greenberg; Werner H. Stemer; Gregory L. Mayback

(57) ABSTRACT

A sheet-braking system and method of operation for a delivery of a sheet-processing machine, includes a braking belt revolving during operation and undergoing periodic decelerating and accelerating phases. The braking belt further includes a braking strand passable over a suction region providing a suction effect passing through the braking strand. The suction region is overlapped throughout the duration of a respective decelerating phase, by a respective sheet deposited on the braking strand.

8 Claims, 2 Drawing Sheets

SHEET-BRAKING SYSTEM FOR A DELIVERY OF A SHEET-PROCESSING MACHINE, AND METHOD OF OPERATION

BACKGROUND OF THE INVENTION

Field of the Invention

The invention relates to a sheet-braking system for a delivery of a sheet-process machine, in particular, a printing machine, having a braking belt which revolves during operation and undergoes periodic decelerating and accelerating phases, the braking belt including a braking strand passable over a suction region providing a suction action passing through the braking strand, and further relates to a rotary printing machine equipped with the sheet-braking system.

A sheet-braking system of the aforementioned type has become known heretofore, for example, from German Patent 196 49 824. A suction conveyor disclosed in this document is used, in accordance with an exemplary embodiment described therein, as a sheet-braking system. The latter includes a braking belt which revolves non-uniformly during operation and has a braking strand, a respectively processed sheet being transferable to the braking belt at the processing speed of the sheet, without any speed relative to the braking belt, by a sheet-transporting sheet conveyor, and being pressable a sheet-transporting sheet conveyor, and being pressable against the braking strand with a suction effect, so that a sheet respectively pressed against the braking strand follows the speed variation of the braking belt under a retaining force acting between the sheet and the braking strand, and is thus braked when the braking belt is decelerated.

For the purpose of producing the suction action, a suction-chamber device is provided which is connected to a negative-pressure generator via a suction-intake union, and subjects a suction-air flow passing through the suction-chamber device to a throttling action, and extends in the form of a channel in the travel direction of the braking strand. In a configuration of the conventional suction conveyor which is suitable, in particular, for braking sheets, the suction intake union or opening is provided at a downline end of the channel, as viewed in the travel direction of the braking strand. This measure is taken in conjunction with the throttling action so that, during the progressive release of the suction-chamber device by the sheet guided by the braking strand, a retaining force would still be maintained between the sheet and the braking strand, this retaining force being necessary whenever the sheet is to be braked by the braking strand. However, this retaining force decreases with the progressive release of the suction-chamber device, so that, in comparison with the case wherein the suction-chamber device is entirely covered by a sheet, lower retaining forces, and thus lower deceleration of the respective sheet, can be achieved. With relatively high processing speeds, however, this requires relatively long decelerating distances for braking the sheets to an adequate depositing speed, which must be selected so that the braked sheets released by the sheet-braking system come into contact with leading-edge stops, and are aligned thereon for a straight-edge construction of a pile or stack formed from the sheets, without damaging any of the leading edges of the sheets, respectively.

The relatively long decelerating phases which are consequently necessary for the non-uniformly revolving braking belt result, particularly during the processing of sheets of a maximum format that can be transported by the sheet conveyor, in a sheet which is transported over the sheet-braking system at the processing speed by the sheet conveyor, with positive guidance at the leading edge thereof, having a leading section already located in the region of the sheet-braking system while a trailing section of an advanced or preceding sheet that is still being braked adheres to the braking strand. This may result, however, in mutual contact between successive sheets in the case wherein relative speeds exist between the sheets, and in consequent damage to the printed images applied to the sheets.

SUMMARY OF THE INVENTION

It is accordingly an object of the invention to provide a sheet-braking system for a delivery of a sheet-processing machine, in particular, a printing machine, wherein sheets passing through the machine are braked from a processing speed to a depositing speed over the shortest possible distance.

With the foregoing and other objects in view, there is provided, in accordance with one aspect of the invention, a sheet-braking system for a delivery of a sheet-processing machine, comprising a braking belt revolving during operation and undergoing periodic decelerating and accelerating phases, said braking belt including a braking strand passable over a suction region providing a suction effect passing through said braking strand, said suction region being overlapped throughout the duration of a respective decelerating phase, by a respective sheet deposited on the braking strand.

In accordance with another feature of the invention, a respective decelerating phase is terminatable with the arrival of the trailing edge of a respective sheet at the suction region.

In accordance with a further feature of the invention, the suction region is limited to a downline section of the braking strand, as viewed in the travel direction of the braking strand.

In accordance with an added feature of the invention, the sheet-braking system includes a beginning of a respective decelerating phase of the braking belt after the trailing edge of a respective sheet deposited on the braking strand has reached the braking strand.

In accordance with another aspect of the invention, there is provided a sheet-processing rotary printing machine, including a sheet-braking system for a delivery of the sheet-processing machine, comprising a braking belt revolving during operation and undergoing periodic decelerating and accelerating phases, the braking belt including a braking strand passable over a suction region providing a suction effect passing through the braking strand, the suction region being overlapped throughout the duration of a respective decelerating phase, by a respective sheet deposited on the braking strand.

In accordance with a further aspect of the invention, there is provided a method of operating a sheet-braking system for a delivery of a sheet-processing machine, which comprises, during operation, revolving a braking belt with periodic decelerating and accelerating phases, passing the braking belt, including a braking strand thereof, over a suction region providing a suction effect passing through the braking strand, overlapping the suction region throughout the duration of a respective decelerating phase, by a respective sheet deposited on the braking strand.

In accordance with an added mode, the method of the invention includes terminating a respective decelerating phase upon the arrival of the trailing edge of a respective sheet at the suction region.

In accordance with a concomitant mode, the method of the invention includes beginning a respective decelerating phase of the braking belt after the trailing edge of a respective sheet deposited on the braking strand has reached the braking strand.

Thus, in order to achieve the object of the invention, a sheet-braking system of the type mentioned in the introduction hereto is provided so that, throughout the duration of a respective decelerating phase, the suction region of the sheet-braking system is overlapped by a respective sheet which is deposited on the braking strand.

This measure prevents the situation wherein the retaining force which presses a respective sheet against the braking strand decreases during a respective decelerating phase.

Throughout the duration of a respective decelerating phase, a constant retaining force is thus available and, with a corresponding magnitude of the retaining force, the latter allows a greater deceleration of a respective sheet than a retaining force which decreases during a deceleration.

In a preferred configuration, the overlapping of the suction region for the duration of a respective decelerating phase is realized in that a respective decelerating phase is terminated at the latest with the arrival of the trailing edge of a respective sheet at the suction region.

Furthermore, the suction region is preferably restricted or limited to a downline section of the braking strand, as viewed in the travel direction of the braking strand.

In a further preferred configuration, a respective decelerating phase begins once the trailing edge of a respective sheet deposited on the braking strand has reached the braking strand.

Other features which are considered as characteristic for the invention are set forth in the appended claims.

Although the invention is illustrated and described herein as embodied in a sheet-braking system for a delivery of a sheet-processing machine and method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

The production and stacking of satisfactory printed products by a rotary printing machine presupposes, in particular, that, during transportation of the printed products en route from a final processing station to a stacking station, a printed image applied to a printing material is not damaged either by collisions of the printed products with machine parts or by collisions thereof with one another.

Figure 1:
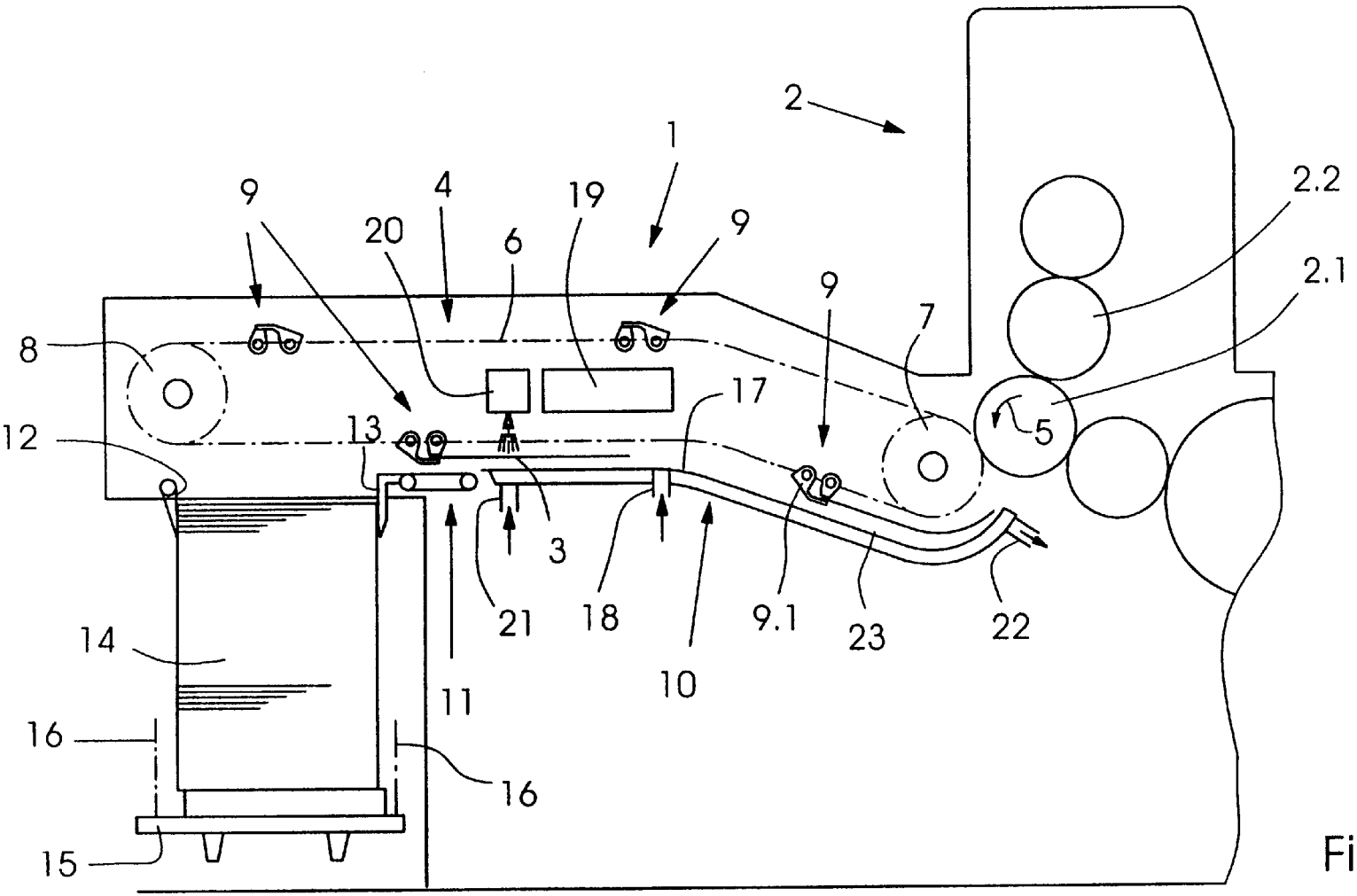
FIG. 1 is a fragmentary diagrammatic side elevational view of a rotary printing machine with a delivery incorporating the sheet-braking system according to the invention.

Referring now to the drawings and, first, particularly to FIG. 1 thereof, there can be seen therein the path over which the transportation takes place. This transportation occurs in a delivery which follows a final processing station of a sheet-processing rotary printing machine. Such a processing station may be a printing unit or a post-treatment unit, for example, a varnishing unit. In the example at hand, the final processing station is an offset printing unit 2 with an impression cylinder 2.1. The latter guides a respective sheet 3 in a processing direction indicated by an arrow 5 representing the direction of rotation of the impression cylinder 2.1, through a nip between the impression cylinder 2.1 and a blanket cylinder 2.2, which cooperates with the impression cylinder 2.1, and then transfers the sheet 3 to a chain conveyor 4. In the process, grippers which are arranged on the impression cylinder 2.1, and are provided for gripping the sheet 3 at a gripper border at the leading end of the sheet, are opened. The chain conveyor 4 includes two conveyor chains 6, of which, respectively, one chain 6 revolves along a respective side wall of the chain delivery 1 during operation. A respective conveyor chain 6 wraps around one of two synchronously driven drive sprocket wheels 7, respectively, the axes of rotation of which are aligned with one another, and, in the example at hand, is guided over a respective deflecting or guide sprocket wheel 8 which is located downline of the drive sprocket wheel 7, as viewed in the processing direction. Extending between the two conveying chains 6 are gripper systems 9 carried by the conveying chains 6. The gripper systems 9 have grippers 9.1, which pass through gaps formed between the grippers which are arranged on the impression cylinder 2.1, and thus take over a respective sheet 3 by gripping a gripper margin at the leading end of the sheet 3, immediately before the grippers arranged on the impression cylinder 2.1 are opened, then transport the sheet via a sheet-guiding device 10 to a sheet-braking system 11, and open thereat in order to transfer the sheet 3 to the sheet-braking system 11. The latter imparts to the sheets a depositing speed which is lower than the processing speed, and releases the sheets after they have reached the depositing speed, with the result that a respective then slowed-down sheet 3 finally comes into contact with leading-edge stops 12 and, after being aligned with the latter and with trailing-edge stops 13, which are located opposite the leading-edge stops 12, forms together with preceding and/or following sheets 3, a sheet pile 14 that is lowerable by a lifting mechanism to the same extent as the sheet pile 14 grows. The lifting mechanism is represented in FIG. 1 only by a platform 15 bearing the sheet pile 14, and lifting chains 16, which bear the platform 15 and are indicated in phantom, i.e., by dash-dot lines.

Along the paths thereof between the drive sprocket wheels 7, on the one hand, and the deflecting sprocket wheels 8, on the other hand, the conveyor chains 6 are guided by chain-guide rails, which thus determine the paths of the chain strands. In the example illustrated in FIG. 1, the sheets 3 are transported by the chain strand which is shown closer to the bottom of FIG. 1. That section of the chain path through which the chain strand passes is followed alongside by a sheet-guiding surface 17 formed on the sheet-guiding device 10 and facing towards the chain path. A sheet-guiding flow is preferably formed, during operation, between the sheet-guiding surface 17 and the respective sheet 3 guided thereover. In this regard, the sheet-guiding device 10 is equipped with blast or blowing-air nozzles terminating in the sheet-guiding surface 17. Only one of the blowing-air nozzles is illustrated at 18 in FIG. 1, as symbolically representative of the multiplicity thereof.

In order to prevent the printed sheets 3 in the pile 14 from sticking together, a dryer 19 and a spray powder device 20 are provided on the path of the sheets 3 from the drive sprocket wheels 7 to the sheet-braking system 11.

In order to avoid excessive heating of the sheet-guiding surface 17 by the dryer 19, there is integrated in the sheet-guiding device 10 a coolant circuit represented symbolically in FIG. 1 by an inlet nozzle 21 and an outlet nozzle 22 on a coolant tray 23 assigned to the sheet-guiding surface 17.

A critical section of the transporting path is located in the region of the sheet-braking system 11, the functional capability of which ultimately determines the processing speed at which the rotary printing machine can be operated.

The sheet-braking system 11 includes a number of endless braking belts 24 distributed transversely to the processing direction, and revolving during operation. The braking belts 24 are formed as toothed belts which are constructed with toothing in respective border or marginal regions thereof. The toothings of a respective braking belt 24 engage with a set of drive gears 25 and a set of deflecting gears 26, which have, respectively, one of the braking belts 24 wrapped around them, the braking belts being subjected to a given stressing in the process.

Figure 2:
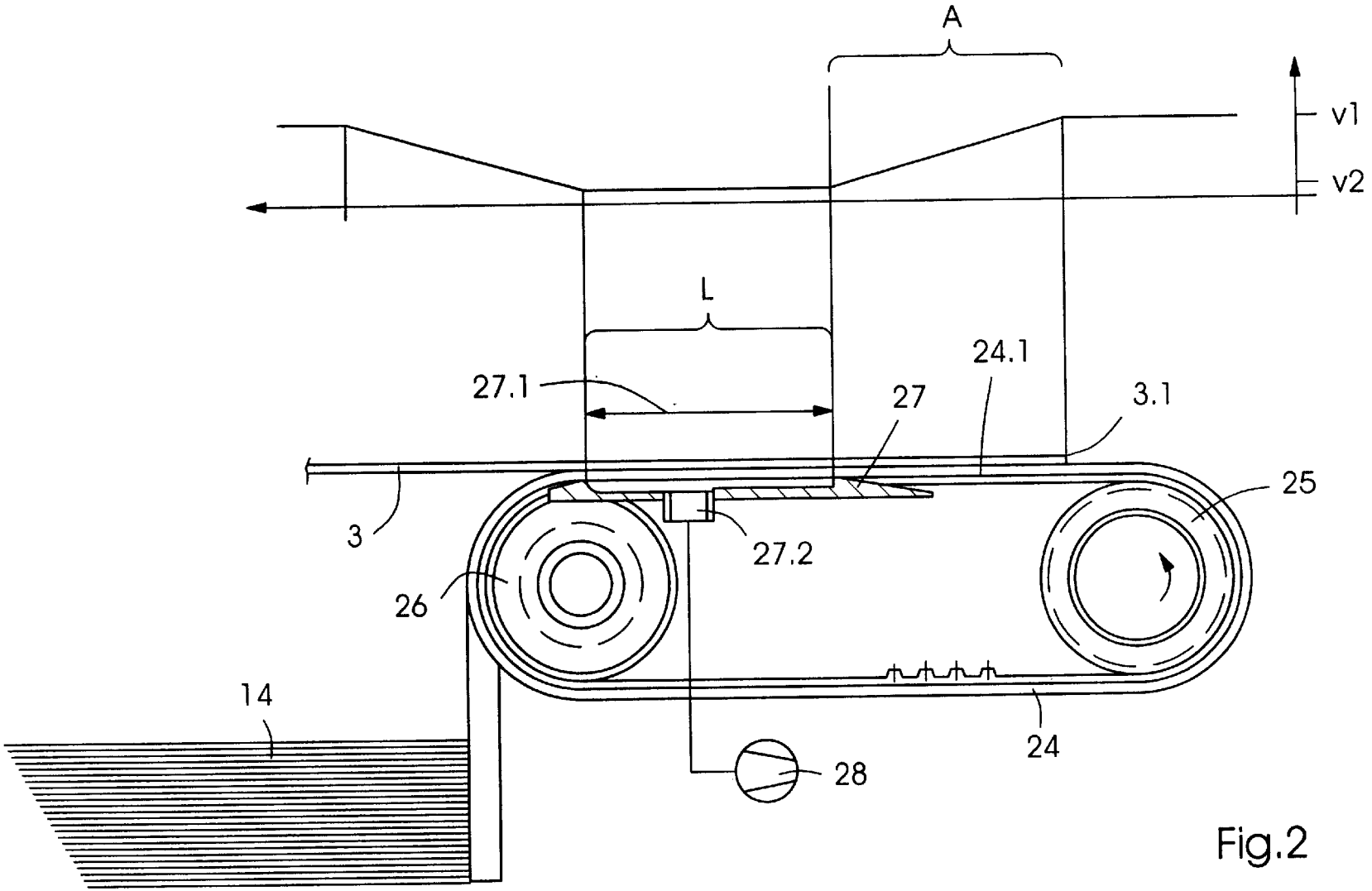
FIG. 2 provides an enlarged fragmentary view of FIG. 1 showing a braking belt with a braking strand, which revolves during operation, passing over a suction region, from which a suction action prevailing therein passes through the braking strand, and also provides a plot diagram illustrating the qualitative variation in the speed of the braking strand, depending upon the position, relative to the suction region, of the sheet gripped by the braking strand, and following a release of the sheet.

The braking belt 24 which, in FIG. 2, is illustrated in the position wherein it has been installed in the sheet-braking system 11, forms a braking strand 24.1, which is located at the top of FIG. 2. A smooth inner surface of the braking belt 24, which is formed between the toothed margins of the braking belt 24, passes over a suction region 27.1 during operation. In the example shown in FIG. 2, the suction region is formed by a depression in a surface belonging to a suction table 27, which is directed towards the inner surface of the braking strand 24.1, the suction table 27 having been positioned against the inner surface of the braking strand 24.1. The depression is arranged so that the braking strand 24.1 is disposed thereover. The depression, which forms the suction region 27.1, is connected, during operation, to a negative-pressure generator 28, which is shown only symbolically in the figure, via a suction nozzle 27.2. The braking belt 24 is constructed so as to have a suction effect passing therethrough, which prevails in the suction region 27.1 during operation.

The set of drive gears 25 is connected to a non-illustrated highly dynamic drive which can produce pronounced accelerations and decelerations of the braking belt 24. Under the action of this drive, the braking belt 24, during operation, undergoes periodic decelerating and accelerating phases, which follow after one another at given time intervals.

A corresponding qualitative plot diagram, with respect to the amounts of the speeds, of the course of the speed v of the braking belt 24 along the distance covered thereby during part of the revolution of the braking belt 24 is correlated directly in FIG. 2 with positions which a sheet 3 gripped by the braking strand 24.1 assumes relative to the suction region 27.1.

As has already been indicated hereinbefore, a respective sheet 3 is transferred to the sheet-braking system 11 by the sheet-guiding grippers 9.1 of a gripper system 9 (note FIG. 1), with the result that the sheet 3 is gripped by the braking strand 24.1 under the suction effect passing through the braking strand 24.1, which has a length equal to a fraction of the extent of the sheet 3 in the travel direction thereof. This transfer preferably takes place without any difference between the transporting speed of the grippers 9.1, on the one hand, and the revolving speed of the braking belt 24, on the other hand. This common speed v1 is maintained by the braking belt 24 until, under the action of the aforementioned drive, a decelerating phase commences, which preferably takes place at an instant of time at which the braking strand 24.1 guides a trailing section of the sheet 3 under the aforementioned suction effect to which the sheet is subjected. If necessary or desirable, from an instant of time preceding the aforementioned instant of time at which the sheet has been received under the suction effect, until the aforementioned instant of time at which the decelerating phase commences, the suction region 27.1, above which the braking strand 24.1 passes, is covered or overlapped by the sheet 3 guided by the braking strand 24.1.

In the illustrated configuration of the sheet-braking system 11, this covering or overlapping is also maintained throughout the duration of the decelerating phase. For this purpose, the extent L of the suction region 27.1 in the longitudinal direction of the braking strand 24.1, on the one hand, and the instantaneous positions the sheet 3 guided by the braking strand 24.1 are coordinated with one another so that, at the aforementioned instant of time at which the decelerating phase commences, the sheet 3 still has, upline of the suction region 27.1, as viewed in the travel direction of the sheet, an extent, adjacent to the suction region 27.1, which corresponds at least to the extent L of the suction region 27.1 in the longitudinal direction of the braking strand 24.1, i.e., with the sheet 3 in a straightened-out condition, the trailing edge 3.1 of the sheet 3 is spaced apart, at the aforementioned instant of time, from the suction region 27.1 a distance A which is at least equal to the extent L of the suction region 27.1 in the longitudinal direction of the braking strand 24.1. Furthermore, the distance covered by the braking strand 24.1 and/or the sheet 3 during the decelerating phase corresponds at most to the length of a section of the sheet 3 which follows upline of the suction region 27.1.

Until the instant of time at which the decelerating phase commences has been reached, the sheet 3, and thus the trailing edge 3.1 thereof, moves, as has been explained hereinbefore, at the transporting speed of the grippers 9.1, i.e., synchronously with the changes in the rotary position of a cylinder of the printing unit 2. The instant of time at which the decelerating phase commences is thus realizable, in particular, by a system-programmable control which is linked with an angular-position transducer for the rotary positions of a cylinder of the printing unit 2 and with the aforementioned drive and, in the presence of a corresponding angle-of-rotation position of the cylinder, initiates a braking operation of the drive.

In an exemplary embodiment for terminating the decelerating phase, the upline end of the suction region 27.1, as viewed in the travel direction of the sheets 3, has a sensor assigned thereto which senses the passage of the trailing edge 3.1 of a respective sheet 3 and is linked with the control, so that a signal emitted by the sensor when the trailing edge 3.1 of a respective sheet 3 passes is processed by the control with the effect of terminating the braking operation of the drive. A respective sheet 3 is then transported farther at a depositing speed v2, which is reached at the end of the decelerating phase and is lower than the processing speed v1, until the sheet 3 leaves the braking strand 24.1, with the suction region 27.1 being released to an increasing extent in the process, and then, with a simultaneous lowering action, the sheet 3 moves towards the leading-edge stops 12, which can be seen in FIG. 1.

In an exemplary embodiment, the downline end of the suction region 27.1, as viewed in the travel direction of the sheets 3, likewise has a sensor assigned thereto which is linked with the control. The signal which is emitted by the sensor when the trailing edge 3.1 of the sheet 3 passes is processed in the control with the effect of accelerating the drive of the braking belt 24. The accelerating phase of the braking belt 24 which is thus commenced is terminated by the aforementioned control when the braking belt 24 has reached the transporting speed v1 of the grippers 9.1 again, and this speed of the braking belt 24 is maintained until the previously explained decelerating phase recommences, this being followed, in turn, by a phase at the depositing speed v2 and finally, once again, by the afore-explained accelerating phase, in order for a following sheet 3, through the intermediary of the sheet-braking system 11, to be received from the grippers 9.1 in the manner explained hereinabove, then braked and released. The decelerating and accelerating phases which follow after one another at given time intervals thus proceed periodically in cycle with the successive sheets 3.

In the configuration of the sheet-braking system 11 which has been explained thus far, during the decelerating phase, a trailing end section of a respective sheet 3 is located upline of the suction region 27.1, as viewed in the travel direction of the sheet. Such an end section runs the risk of being folded back due to the braking action initiated in a section which precedes the end section. Possible causes of this are the inertia of the trailing end section and an under-blowing of the end section due to an entraining or pulling flow produced by a following gripper system 9. If, however, a support is provided upline, following the suction region 27.1, for at least a considerable part of the trailing end section, the support making it possible for a part of the trailing end section of the respective sheet 3 following upline of the suction region 27.1 to rest in a straightened-out or stretched planar manner, then this has a stabilizing effect upon the end section. This is advantageously realized in that the suction region 27.1 is restricted to a downline section of the braking strand 24.1, as viewed in the travel direction of the braking strand 24.1.

An advantageous development or improvement thereof also provides, as is illustrated in FIG. 2, that a respective decelerating phase commence only after the trailing edge 3.1 of a respective sheet 3 deposited on the braking strand 24.1 has reached the braking strand 24.1. The aforementioned support for the trailing end section of a respective sheet 3, that end section following upline of the suction region 27.1, is thus realized by the number of braking belts distributed transversely to the processing direction.

The configuration of the sheet-braking system which has thus been explained heretofore is suitable, in particular, for relatively high processing speeds. It makes a short discharge path for the braked sheets 3 possible, and results in only a slight imbrication of sheets.

We claim:

1. A sheet-braking system for a sheet delivery of a sheet-processing machine, comprising:

a suction table flaying a suction region;

a braking belt revolving during operation and undergoing periodic decelerating and accelerating phases, said braking belt including a braking strand passable over said suction region providing a suction effect passing through said braking strand, said suction region being covered throughout the duration of a respective decelerating phase, by a respective sheet deposited on said braking strand.

2. The sheet-braking system according to claim 1, wherein the respective decelerating phase is terminatable with the arrival of a trailing edge of the respective sheet at said suction region.

3. The sheet-braking system according to claim 1, wherein said suction region is limited to a downline section of said braking strand, as viewed in the travel direction of said braking strand.

4. The sheet-braking system according to claim 1, wherein the respective decelerating phase of said braking belt begins after the trailing edge of the respective sheet deposited on said braking strand has reached said braking strand.

5. A sheet-processing rotary printing machine, including a sheet-braking system for a sheet delivery of the sheet-processing machine, the sheet-braking system comprising:

a suction table having a suction region;

a braking belt revolving during operation and undergoing periodic decelerating and accelerating phases, said braking belt including a braking strand passable over said suction region providing a suction effect passing through said braking strand, said suction region being covered throughout the duration of a respective decelerating phase, by a respective sheet deposited on said braking strand.

6. A method of operating a sheet-braking system for a sheet delivery of a sheet-processing machine, which comprises, during operation:

revolving a braking belt with periodic decelerating and accelerating phases;

passing the braking belt, including a braking strand thereof, over a suction region providing a suction effect passing through the braking strand; and covering the suction region throughout the duration of a respective decelerating phase, by a respective sheet deposited on the braking strand.

7. The method according to claim 6, which comprises terminating the respective decelerating phase upon the arrival of the trailing edge of the respective sheet at the suction region.

8. The method according to claim 6, which includes beginning a respective decelerating phase of the braking belt after the trailing edge of a respective sheet deposited on the braking strand has reached the braking strand.

* * * * *

UNITED STATES PATENT AND TRADEMARK OFFICE

CERTIFICATE OF CORRECTION

PATENT NO. : 6,691,999 B2
APPLICATION NO. : 09/737058
DATED : February 17, 2004
INVENTOR(S) : Frank Gunschera et al.

It is certified that error appears in the above-identified patent and that said Letters Patent is hereby corrected as shown below:

Title Page,
Item (75) Inventors: Frank Gunschera, Nussloch (DE); Roland Hirth, Römerberg (DE); Sven Kerpe, Eggenstein-Leopoldshafen (DE); Richard Mack, Kennesaw, GA (US); Ralf Weiser, Ladenburg (DE)

Column 8, line 4, should read as follows:

a suction table having a suction region;

Signed and Sealed this

Twenty-seventh Day of February, 2007

JON W. DUDAS
*Director of the United States Patent and Trademark Office*